United States Patent [19]

Milum

[11] Patent Number: 4,498,360

[45] Date of Patent: Feb. 12, 1985

[54] SHARPENER FOR A SPREADING TOOL

[76] Inventor: J. David Milum, Rte. 5, Cumming, Ga. 30130

[21] Appl. No.: 532,194

[22] Filed: Sep. 14, 1983

[51] Int. Cl.[3] ..... B21K 5/12

[52] U.S. Cl. ..... 76/88; 76/82.1; 76/82.2; 76/83; 30/283; 30/289

[58] Field of Search ..... 76/88, 82, 82.2, 83, 76/82.1; 51/205 WG; 30/278, 283, 289, 294, 293, DIG. 3

[56] References Cited

U.S. PATENT DOCUMENTS

| | | | |
|---|---|---|---|
| 25,714 | 6/1896 | Adams | 76/82.2 |
| 1,190,718 | 7/1916 | Brunsell | 76/82 |
| 1,335,813 | 4/1920 | Berghman | 51/205 WG |
| 2,790,339 | 4/1957 | Brink | 76/82 |
| 3,585,880 | 6/1971 | Kabriel | 76/83 |

*Primary Examiner*—Roscoe V. Parker
*Attorney, Agent, or Firm*—Jones & Askew

[57] ABSTRACT

A hand-held sharpening tool is provided for sharpening sheet-like tools, such as plastic spreaders used to apply putty or plastic filler. A trimming blade is mounted in a central block, and a guide slot leading to the cutting edge is provided by upper and lower guide blocks connected to the blade mounting block. One of the guide blocks is spring loaded toward the other so as to yieldingly comply with the width of a spreader inserted into the guide slot for sharpening. A set of conveniently located set screws is provided to retain and adjust the trimming blade. The sharpening tool of the invention can be used to substantially prolong the life of plastic spreaders which would otherwise quickly become unusable.

8 Claims, 5 Drawing Figures

SHARPENER FOR A SPREADING TOOL

TECHNICAL FIELD

This invention relates to sharpening tools, and more particularly relates to a sharpening tool having a knife blade for trimming the working edge of a blade-like spreading tool of the type used to apply putty or body filler.

BACKGROUND ART

Plastic body filler or putty is commonly used to repair damage to sheet metal surface, such as the body of an automobile after an accident. The filler is applied with a spreading tool having an even, tapered working edge, so that the filler can be applied with an even, unblemished surface. When the filler is applied with a smooth surface, the time and effort required to file, sand, and otherwise prepare the surface for painting is considerably reduced.

In recent years disposable spreaders made of flexible plastic have received wide spread acceptance. It is not necessary to clean such disposable spreaders for reuse, and they are simply discarded if the working edge if damaged. While plastic disposable spreaders are less expensive than a metal putty knife, the working edge of a plastic spreaders can be nicked easily, and normally must be discarded after only a brief period of use. Thus, the cost of obtaining multiple plastic spreaders is significant, and there has been a need for a way in which to prolong the useful life of plastic spreaders.

SUMMARY OF THE INVENTION

The present invention satisfies the need for prolonging the useful life of spreading tools by providing means for sharpening the working edge of a spreading tool by removing nicks and cuts that would streak putty, or filler, or the like being applied by the spreading tool.

Generally described, the present invention provides an apparatus for sharpening an edge of a sheet-like member, comprising a guide surface abutting a barrier along an edge of the guide surface, and means for mounting a blade extending through the barrier, the blade including a cutting edge intersecting the guide surface, and the sheet-like member being insertable between the guide surface and a means for urging the sheet-like member against the guide surface. More particularly described, the present invention comprises means for defining a slot including a pair of generally parallel side walls for receiving the sheet-like member therebetween, means for mounting the blade extending into the slot through an end wall of the slot, and means for automatically adjusting the distance between the side walls of the slot to equal the thickness of the sheet-like member.

Preferably, the slot is disposed at an angle with respect to the barrier or end wall and the cutting edge of the blade. The blade can be mounted in a blade mounting block which defines a slit extending diagonally into the front surface of the mounting block for receiving the blade, and set screws extending through threaded bores from the rear surface of the mounting block to engage the blade and hold it in place within the slit. Adjacent to the location at which the blade cutting edge protrudes from the slit, a gullet is provided in the mounting block for receiving shavings removed from the spreading tool by the blade.

A recess extends into the back surface of the mounting block and meets the gullet so that the shavings pass from the gullet through an opening into the recess, from which they can easily be discarded.

The slot into which the sheet-like member, such as a spreading tool is inserted for sharpening can be formed by an upper guide block which includes a horizontal member shaped to be placed upon an upper surface of the blade mounting block, a first vertical surface extending from the horizontal plate along the front surface of the blade mounting block to define a lower edge at or above the opening between the gullet and the recess, and a first diagonal surface extending outwardly and downwardly from the lower edge of the first vertical surface. The other side wall of the slot can be defined by a lower guide block which includes a block receiving surface for receiving a lower surface of the blade mounting block, a second vertical surface extending upwardly along the front surface of the blade mounting block and defining an upper edge at or below the opening between the gullet and the recess, and a second diagonal surface extending outwardly and downwardly from the upper edge of the second vertical surface roughly parallel to the first diagonal surface. Thus, the parallel diagonal surfaces provide the side walls of the slot and the front surface of the blade mounting block provides the barrier at the end of the slot through which the cutting edge protrudes.

The upper guide block is preferably mounted slidably on vertical rods and is spring biased toward the lower guide block. In use, a spreading tool blade is inserted into the slot until it meets the barrier formed by the blade mounting block. Then the spreading tool is drawn along the slot so that its edge is trimmed by the cutting edge of the blade. If the spreading tool is thicker than the initial dimension of the slot, the upper guide block will yield under the spring pressure to accommodate the thicker spreading tool. The angle of the adjustable-width slot with respect to the cutting edge provides a beveled edge at the end of the spreading tool suitable for smooth application of putty, filler, or the like.

The sharpening tool according to the invention can be assembled for use by either right handed or left handed persons. To change the orientation, the guide mounting block need only be rotated 180° with respect to the upper and lower guide blocks. This can be accomplished by providing removable rods connected to the guide blocks in spring-loaded fashion as described above.

Thus, it is an object of the present invention to provide an improved sharpening tool for sheet-like spreading tools.

It is a further object of the present invention to provide a sharpening tool that can accommodate spreading tools of varying thicknesses.

It is a further object of the present invention to provide a cutting tool that is safe in operation, can be assembled for either right or left handed use, provides for easy cutting blade adjustment or replacement, and prevents cutting blade breakage.

It is a further object of the present invention to provide a sharpening tool which can substantially increase the life of plastic spreading tools used to apply putty, filler or the like.

Other objects, features, and advantages of the present invention will become apparent in the following detailed description of a preferred embodiment of the invention, when taken in conjunction with the drawings and the appended claims.

DETAILED DESCRIPTION OF THE DRAWINGS

Figure 1:
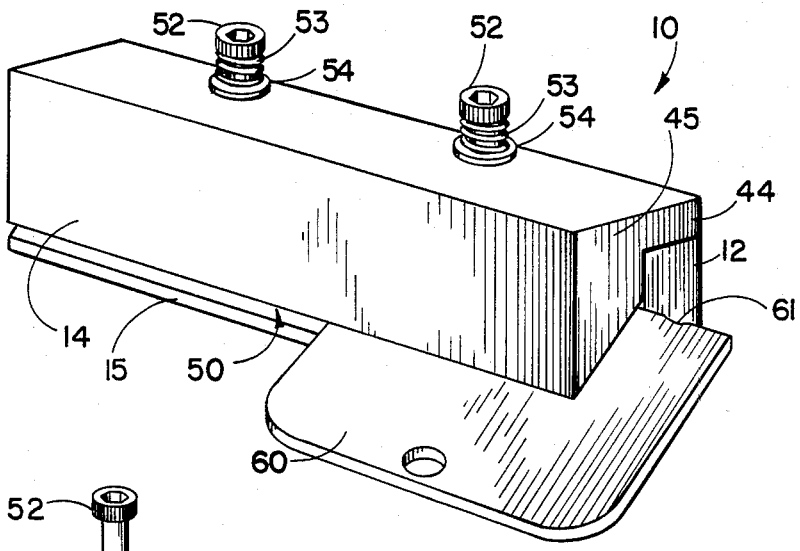
FIG. 1 is a pictorial view of a sharpening tool embodying the present invention.
Figure 2:
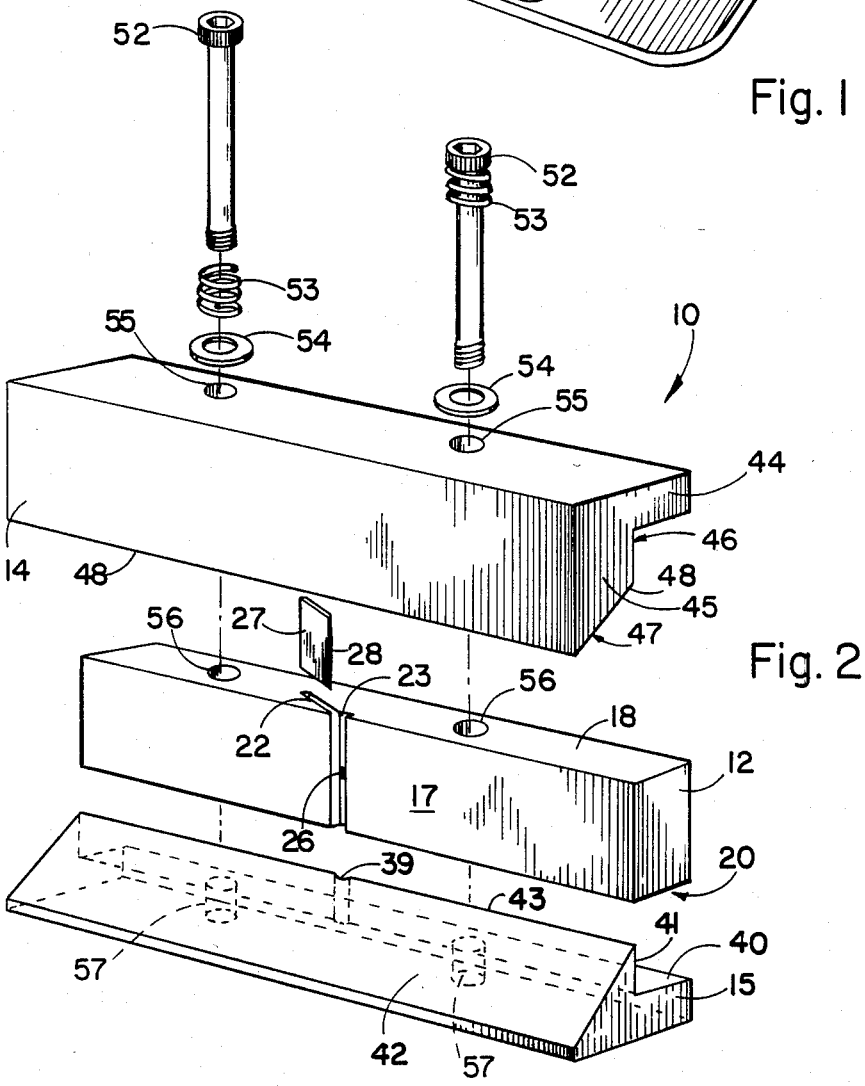
FIG. 2 is an exploded view of the sharpening tool shown in FIG. 1.

Referring now in more detail to the drawings, in which like numerals refer to like parts throughout the several views, FIG. 1 shows an assembled sharpening tool 10 embodying the invention. As best shown in FIG. 2, the preferred embodiment of the sharpener 10 includes a blade mounting block 12 positioned between an upper guide block 14 and a lower guide block 15. The blocks 12, 14 and 15 can comprise metal, hard plastic, or the like.

The blade mounting block 12 is a rectangular block defining a front surface 17, a top surface 18, a back surface 19, and a bottom surface 20. A blade slit 22 is cut diagonally into the center portion of the front surface 17 of the mounting block 12. Along the intersection of the slit 22 and the front surface 17, a gullet 23 is cut out of the front surface 17.

Figure 3:
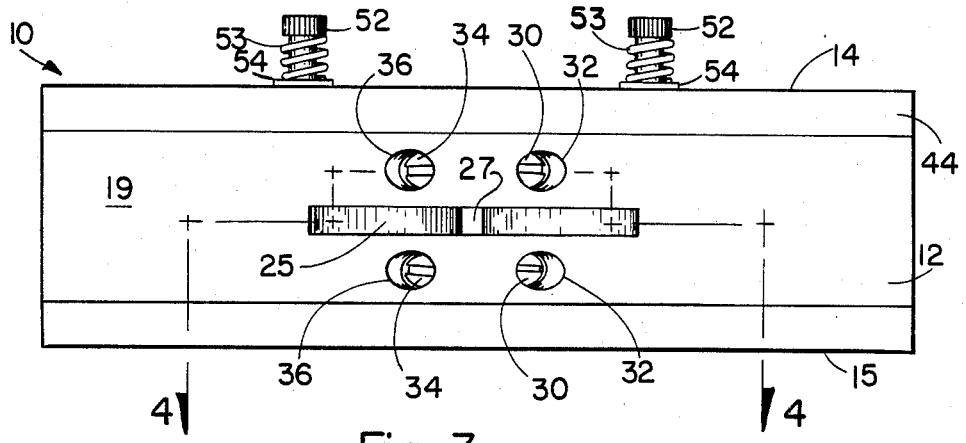
FIG. 3 is a rear plan view of the sharpening tool shown in FIG. 1.
Figure 4:
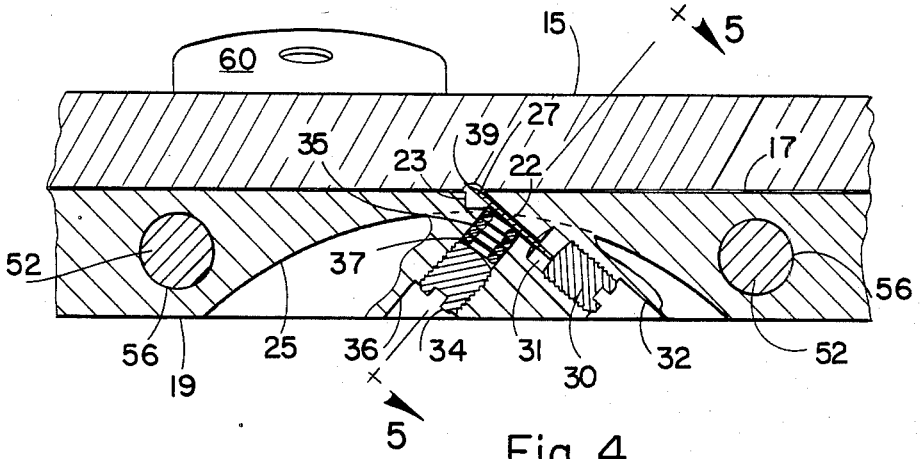
FIG. 4 is a horizontal cross sectional view taken along line 4—4 of FIG. 3.
Figure 5:
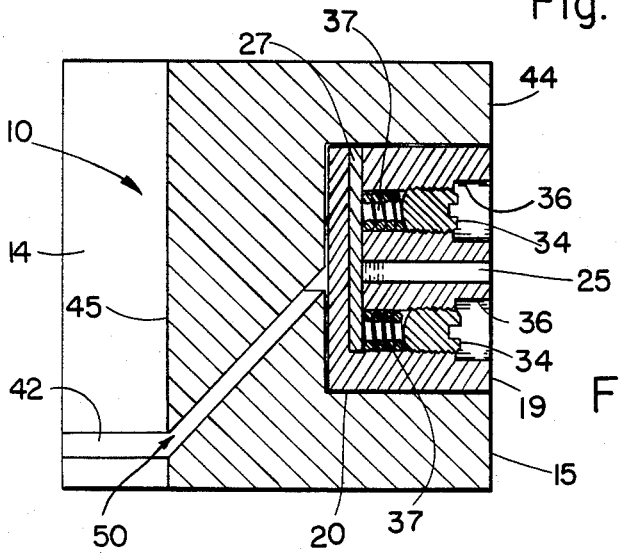
FIG. 5 is a vertical cross sectional view taken along line 5—5 of FIG. 4.

As shown in FIGS. 3–5, an arcuate recess 25 is cut into the rear surface 19 of the mounting block 12, and the recess 25 extends at the center thereof to the front of the mounting block 12 until it intersects and communicates with the gullet 23. Thus, an opening 26 between the gullet and the arcuate recess 25 is formed. As will be explained in more detail hereinafter, shavings removed from a spreading tool during sharpening pass into the gullet 23, through the opening 26 and into the recess 25 for disposal. The shavings are removed from the spreading tool by a blade 27 which is received in the slit 22. The blade includes a cutting edge 28 which is oriented vertically as shown in FIG. 2. The blade 27 is adjustably mounted so that the cutting edge 28 protrudes beyond the front surface 17 of the mounting block 12 by a desired distance, preferably 0.005–0.008 inch.

Adjustment of the position of the blade 27 and its cutting edge 28 is accomplished by means of a pair of set screws 30 accessed from the rear surface 19 of the mounting block 12, shown in FIG. 3. The set screws 30 are preferably inserted through threaded bores 31 which are positioned one above and one below the arcuate recess 25. The bores 31, as shown in FIG. 4, are aligned with the plane of the blade 27 and communicate with the inner end of the blade slit 22. When the blade 27 is inserted into the slit 22, the inner end of the blade 27 extends into the bores 31 and abuts the inner end of the set screws 30. The position of the blade 27 can thus be adjusted by threading the set screws 30 in or out of the bores 31 as desired, using an allen wrench, screw driver or the like. Countersunk recesses 32 are provided to increase the convenience of access to the set screws 30.

Referring further to FIGS. 3–5, once the blade 27 is positioned as desired, the blade is held in place by spring-loaded set screws 34, also positioned one above and one below the recess 25. The set screws 34 are threaded into bores 35 which extend diagonally into the rear surface 19 of the mounting block 12 at right angles to the blade 22. The bores 35 intersect the blade slit 22, so that compression springs 37 can be positioned between set screws 34 and the blade 27. Countersunk recesses 36 are provided for convenience. By positioning the springs 37 between the set screws 34 and the blade 27, instead of rigidly engaging the set screws 34 with the blade, blade breakage can be avoided under many conditions of stress that would break the blade if it was rigidly held in place.

The lower guide block 15 includes a horizontal surface 40 for receiving the lower surface 20 of the blade mounting block 12. A vertical surface 41 of the lower guide block 15 extends upwardly to a horizontal edge 43. When the spreader 10 is assembled, the vertical surface 41 lies against a lower portion of the front surface 17 of the blade mounting block 12, and the edge 43 is positioned at or below the opening 26. A vertical groove 39 is formed in the vertical surface 41 to accommodate the projection of the blade 27 from the front surface 17. The lower guide block 15 also defines a diagonal guide surface 42 which extends outwardly and downwardly from the edge 43, and thus faces diagonally upwardly. The diagonal surface 42 thus provides a fixed guide surface along which a spreading tool 60 can be moved, as shown in FIG. 4.

The upper guide block 14 includes an upper horizontal member 14 which rests upon the upper surface 18 of the blade mounting block 12. A downwardly projecting member 45 extends downwardly from the front portion of the horizontal member 44, and defines a vertical surface 46 facing rearwardly, as shown in FIG. 2. The vertical surface 46 terminates in a horizontal edge 48. When the spreader 10 is assembled, the vertical surface 46 extends along the upper portion of the front surface 17 of the blade mounting block 12, with the edge 48 positioned at or above the opening 26. In order to accommodate the protrusion of the cutting edge 28 of the blade 27, a vertical groove is formed in the vertical surface 46, similar to the groove 39 in the vertical surface 41 of the lower guide block 15. A diagonal guide surface 47 extends outwardly and downwardly from the edge 48, and thus faces downwardly and inwardly. When the sharpener 10 is assembled, the diagonal guide surface 42 and 47 are approximately parallel to one another and spaced apart by a short distance preferably on the order of $\frac{1}{4}$ inch.

It will thus been seen, as best shown in FIG. 1 and FIG. 5 that a slot 50 for receiving and guiding a sheet-like spreader 60 is formed by the diagonal guide surfaces 42 and 49. A barrier or end wall along the inner end of the slot is formed by the front surface 17 of the blade mounting block 12. The spreader 60 is shown inserted into the slot 50 in FIG. 1.

The upper guide block 14, blade mounting block 12, and lower guide block 15 are secured together in a manner best understood by reference to FIG. 2. A pair of bolts 52 pass through compression springs 53 and washers 54 and are inserted through spaced apart vertical bores 55 drilled through the horizontal member 44 of the upper block 14, one on each side of the rear recess 25. The bores 55 are made large enough in diameter to permit the upper block 14 to slide freely but snugly along the bolts. The bolts 52 then pass through a pair of similar bores 56 that are formed in the blade mounting block 12 in alignment with the bores 55. Finally, threaded end portions of the bolts 52 are secured in tapped holes 57 formed in the lower block 15 in alignment with the bores 55 and 56.

The apparatus according to the invention can be assembled for either right handed or left handed use. The configuration shown in the drawing is right handed, that is, the user would hold the spreader 60 to be sharpened in the right hand, and the sharpening tool 10 in the left hand. Assembly is initiated by inserting a blade 27 into the blade slit 22, and adjusting the position of the set screws 30 unitl the cutting edge 28 is parallel to the front surface 17 of the block 12 and protrudes a desired distance from the front surface 17. During adjustment of the blade 27, light pressure can be applied by means of the set screws 34 and the springs 37. When the blade 27 is in the desired position, set screws 34 can be tightened to exert sufficient force on the springs 37 to hold the blade firmly in place, without completely compressing the springs 37. Thus, the blade can move slightly against the springs under stress without breaking.

Following the mounting of the blade 27, the blade mounting block 12 is placed upon the horizontal surface 40 of the lower guide block 15, with the bores 56 through the mounting block 12 aligned over the threaded hole 57, and the blade 27 protruding into the groove 39. The upper guide block 14 is then placed on top of the mounting block 12 with the horizontal member 44 and the vertical surface 46 abutting the upper and front surfaces, respectively, of the mounting block 12, and with the bores 55 aligned with the bores 56. Then the bolts 52 are passed through springs 53, washers 54 and bores 55 and 56, and are threaded into the holes 57 until tension is placed upon the springs 53. The completed right hand assembly is shown in FIG. 1. The slot 50 is formed between the guide surfaces 47 and 42, and the upper guide block 14 is urged toward the lower guide block 15 by the springs 53. The upper guide block 14 thus provides a means for urging a spreader placed within the slot 50 against the guide surface 42. If the spreader 60 is thicker than the width of the slot 50, or if a thicker portion of the spreader 60 has been reached after continued sharpenings, insertion of the spreader into the slot 50 will cause the upper guide block 14 to yield to conform to the thickness of the spreader, and the surfaces 42 and 47 will still provide the guiding function of the slot 50.

In order to use the sharpening tool 10 of FIG. 1, the sharpening tool is grasped in the left hand, with the slot 50 opening away from the palm. The spreader 60 is then inserted into the slot 50 to the right of the cutting edge 28 as viewed in FIGS. 1 and 2. The working edge of the spreader 60 is pressed against the front surface 17 of the mounting block 12, and the spreader is drawn across the cutting edge to remove a layer of plastic or the like from the working edge of the spreader 60. Shavings removed by the cutting edge 28 pass through the gullet 23 and the opening 26 into the recess 25. The process of inserting the spreader and drawing it across the cutting edge can be repeated as often as is necessary to remove nicks and cuts from the working edge of the spreader. After repeated sharpenings of the spreader, the working edge will progress toward the normally thicker end of the spreader which is grasped during application of putty or filler. As the portion of the spreader which is inserted into the slot 50 thickens, the upper guide block 14 will yield against the pressure of the springs 53 to accommodate the thicker workpiece. To remove any slag remaining on the sharpened working edge of the spreader, the spreader can be turned over in the slot 50 and sharpened to bevel the working edge on both sides. If a rounded working edge is desired, plastic sharpeners can then be sanded with 320 or 400 grit sand paper to round the edge.

To assemble the sharpening tool 10 for left handed operation, the components are assembled as described above, with the exception that the surface 18 of the mounting block 12 is positioned as the bottom surface, and the surface 20 is positioned as the top surface. This results in the blade 27 angling out of the mounting block 12 in the opposite direction. A left handed person can then grasp the sharpening tool 10 in the right hand and the spreader 60 in the left hand, and operate the sharpener as described above.

The sharpening tool 10 embodying the present invention provides several unique advantages. The sharpening operation is safe, since the sharp cutting surface is located at the back of the narrow slot 50, and protected by the guide blocks 14 and 15. Blade replacement and adjustment is easily accomplished with one simple tool such as an allen wrench or a screw driver. Precise cutting adjustments can be made. Blade breakage is pevented by spring loaded mounting of the blade. The adjustable guide slot permits sharpening of spreaders of varying widths, and permits sharpening of badly worn spreaders, increasing the life of a plastic spreader as much as 10 to 20 times.

While this invention has been described in detail with particular reference to a preferred embodiment thereof, it will be understood that variations and modifications can be made without departing from the spirit and scope of the invention as described hereinbefore and as defined in the following claims.

What is claimed is:

1. An apparatus for sharpening an edge of a sheet-like member, comprising:

a guide surface abutting a barrier;

means for mounting a blade extending through said barrier, said blade including a cutting edge intersecting said guide surface; and guide means mounted in predetermined spaced-apart relation to said guide surface for urging the sheet-like member against said guide surface;

said sheet-like member being insertable between said guide surface and said guide means to contact said barrier and said cutting edge of said blade associated therewith.

2. An apparatus for sharpening an edge of a sheet-like member, comprising:

means for defining a slot including a pair of generally parallel side walls for receiving said sheet-like member therebetween and an end wall;

means for mounting a blade extending into said slot through said end wall; and means for automatically adjusting the distance between said side walls to equal the thickness of said sheet-like member.

3. The apparatus of claim 2 wherein said side walls are disposed at an angle with respect to said end wall.

4. The apparatus of claim 2, wherein said means for automatically adjusting the distance between said side walls comprises means for slidably connecting said side walls for sliding movement toward and away from one another; and means for biasing one of said side walls toward the other side wall.

5. The apparatus of claim 2, wherein said means for mounting said blade comprises:

a blade mounting block defining a blade holding slit extending diagonally into a front surface of said block; and a set screw extending through a threaded bore from a back surface of said block to engage said blade within said blade holding slit.

6. The apparatus of claim 5, wherein said blade mounting block further defines a gullet in said front surface of said block adjacent to said blade holding slit; and a recess in said back surface of said block, said recess communicating with said gullet to form an opening therebetween, whereby shavings removed from said sheet-like member by said blade pass through said opening into said recess.

7. The apparatus of claim 6, wherein one of said side walls comprises:

an upper guide block including a horizontal plate shaped to be received upon an upper surface of said blade mounting block, a first vertical surface extending from said plate along the front surface of said blade mounting block and defining a lower edge at or above said opening, and a first diagonal surface extending outwardly and downwardly from said lower edge of said first vertical surface;

and wherein the other of said side walls comprises:

a lower guide block including a block receiving surface for receiving a lower surface of said blade mounting block, a second vertical surface extending upwardly along the front surface of said blade mounting block and defining an upper edge at or below said opening, and a second diagonal surface extending outwardly and downwardly from said upper edge of said second vertical surface approximately parallel to said first diagonal surface.

8. The apparatus of claim 7, wherein said means for adjusting the distance between said side walls comprises:

at least one rod fixed to said lower guide block and extending freely through bores in said blade mounting block and said upper guide block;

a compression spring mounted on said rod above said upper guide block; and means for retaining said spring on said rod so as to yieldingly urge said upper guide block toward said lower guide block.

* * * * *